United States Patent [19]

Graff et al.

[11] 4,363,998

[45] Dec. 14, 1982

[54] FLUORESCENT LAMP PROCESSING WHICH IMPROVES PERFORMANCE OF ZINC SILICATE PHOSPHOR USED THEREIN

[75] Inventors: Eugene A. Graff, Cedar Grove; Larry P. Rusch, East Brunswick, both of N.J.

[73] Assignee: Westinghouse Electric Corp., Pittsburgh, Pa.

[21] Appl. No.: 265,018

[22] Filed: May 19, 1981

[51] Int. Cl.[3] ..... H01J 61/48; B05D 7/22

[52] U.S. Cl. ..... 313/487; 427/67; 313/493

[58] Field of Search ..... 427/67; 313/487, 493

[56] References Cited

U.S. PATENT DOCUMENTS

| | | | |
|---|---|---|---|
| 2,607,014 | 8/1952 | Roy et al. | 313/486 |
| 3,348,961 | 10/1967 | Rupp et al. | 427/67 |
| 3,858,082 | 5/1978 | Manders | 313/487 |
| 4,263,530 | 4/1981 | Van Broekhoven et al. | 313/487 |
| 4,305,019 | 12/1981 | Graff et al. | 313/487 |
| 4,315,192 | 2/1982 | Skwirut et al. | 313/487 |

FOREIGN PATENT DOCUMENTS 44-30957 12/1969 Japan .

*Primary Examiner*—James R. Hoffman
*Attorney, Agent, or Firm*—W. D. Palmer

[57] ABSTRACT

Fluorescent lamp incorporates tin oxide conductive coating on the envelope interior surface and the lamp also incorporates phosphor means comprising manganese-activated zinc silicate phosphor, which may be used as a blend constituent. The lamp is processed in such a manner as to improve the performance of the zinc silicate phosphor. In order to improve the adherence of the phosphor to the tin oxide conductive coating, the tin oxide is overcoated with a film of submicron-size aluminum oxide and, in accordance with the present processing, there is included with the aluminum oxide finely divided antimony oxide. The phosphor is then overcoated onto the mixed film of aluminum oxide and antimony oxide, and during the later lehring processing of the coated phosphor, the antimony oxide is volatilized to contact the zinc silicate phosphor to improve the performance thereof.

10 Claims, 3 Drawing Figures

FLUORESCENT LAMP PROCESSING WHICH IMPROVES PERFORMANCE OF ZINC SILICATE PHOSPHOR USED THEREIN

CROSS-REFERENCE TO RELATED APPLICATION

In copending application Ser. No. 198,494 filed Oct. 20, 1980 by Skwirut et al., and owned by the present assignee, is disclosed a fluorescent lamp which uses multiple layers of phosphor with manganese-activated zinc silicate phosphor as a part of an overlying layer. To improve the performance of the zinc silicate phosphor, a small amount of finely divided antimony oxide is added to the first phosphor layer coating paint. The first layer is then lehred at a relatively low temperature and the second phosphor layer which includes the zinc silicate phosphor is applied thereover. On lehring the second-applied phosphor layer, an appreciable portion of the residual antimony oxide in the first-applied layer is volatilized so that it effectively contacts the zinc silicate to improve the performance of this phosphor.

BACKGROUND OF THE INVENTION

This invention generally relates to fluorescent lamps which utilize a conductive coating on the envelope interior surface and, more particularly, to a method for processing such lamps which incorporate manganese-activated zinc silicate phosphor, in order to improve the performance of the zinc silicate phosphor.

The most common fluorescent lamp ballast used in the United States is the so-called rapid-start ballast which is adapted to operate two fluorescent lamps each rated at 40 watts input. Such lamps normally utilize an inert gas filling comprising about two torrs of argon. By replacing the argon with a gas filling comprising about two torrs of a mixture of 80–85 volume percent krypton and 20–15 volume percent neon or 20–15 volume percent argon, the efficacy of the lamp can be slightly improved with a simultaneous decrease in wattage consumption. For example, such a change will typically increase the lamp-operating efficacy by about 6 to 7% percent while simultaneously decreasing the wattage consumption for each lamp from 40 watts to 34 watts. These figures are given only by way of example and are subject to some variations depending upon various design modifications. Such lower wattage lamps can be substituted for the existing higher wattage lamps and thus represent a substantial energy savings.

One of the problems encountered with such a modified inert gas fill is that the lamps are somewhat difficult to start from the rapid-start ballasts. To overcome this problem, it has been found desirable to coat the inner surface of the lamp envelope with a transparent tin oxide conductive coating. This in turn causes phosphor adherence problems. To overcome these adherence problems, it has been found desirable to overcoat the tin oxide conductive coating with a film of sub-micron-size aluminum oxide. The phosphor is then coated over this film of aluminum oxide and the resulting lamp readily starts and operates very efficiently at a lower wattage.

U.S. Pat. No. 3,858,082, dated Dec. 3, 1974 to Thornton, discloses various three-component phosphor blends which can be used in fluorescent lamps in order to provide both good color rendition of illuminated objects and a high light output. One embodiment of a phosphor blend which is disclosed in this patent uses apatite-structured strontium chlorophosphate activated by divalent europium as a blue-emitting phosphor component, manganese-activated zinc silicate phosphor as a green-emitting phosphor component, and yttrium oxide activated by trivalent europium as a red-orange emitting phosphor component. The relative proportions of these components can be varied to provide the lamp with a predetermined correlated color temperature, and the most popular color temperature for these lamps is about 3,000° K. The overall performance of such lamps is excellent, but on occasion the green-emitting phosphor component displays a relatively rapid depreciation of light output, particularly in the vicinity of the electrodes, which causes a color shift to occur. This can be considered objectionable from an aesthetic standpoint and the alumina precoat appears to aggravate this problem.

It is well known to add a small amount of antimony oxide to a silicate-type phosphor in order to improve the performance thereof, as disclosed in U.S. Pat. No. 2,607,014 dated Aug. 12, 1952 to Roy et al. In U.S. Pat. No. 3,348,961 dated Oct. 24, 1967 to Ropp et al., is disclosed adding a small predetermined amount of finely divided antimony oxide to the paint used for coating manganese-activated zinc silicate, in order to improve the performance of the fluorescent lamp which incorporates the zinc silicate phosphor.

The internationally accepted procedure for standardizing and measuring the color-rending properties of light sources is set forth in the publication of The International Commission on Illumination, identified as Publication CIE No. 13(E-1.3.2) 1965. More recently, a color-preference index has been proposed for rating the performance of the light sources in accordance with what the normal observer considers to be the preferred coloration for familiar objects. This color preferance index (CPI) is summarized in the Journal of the Illuminating Engineering Society, pages 48–52 (Oct. 1974) article entitled "A Validation of the Color-Preference Index" by W. A. Thornton.

SUMMARY OF THE INVENTION

The basic fluorescent lamp which is being improved comprises a sealed elongated light-transmitting envelope having electrodes operatively positioned therein proximate the ends thereof and enclosing a discharge-sustaining filling comprising mercury and a small charge of inert ionizable starting gas. A transparent electrically conducting coating substantially comprising tin oxide is carried on the interior surface of the envelope and a thin substantially transparent coating or film principally comprising sub-micron-size aluminum oxide particles is carried on the tin oxide coating. Finely divided phosphor means is coated over the aluminum oxide, and this phosphor means comprises either the zinc silicate or a blend of predetermined amounts of different phosphors which are formed in at least one discrete phosphor layer. If a blend of phosphors are used, the phosphor means includes as a constituent thereof manganese-activated zinc silicate phosphor. The lamp is fabricated in accordance with the improved processing step and improved method which comprises:

In the lamp manufacturing process, and after the tin oxide coating has been applied to the envelope, predetermined proportions of sub-micron-size aluminum oxide and finely divided antimony oxide are suspended in a liquid vehicle, and the vehicle-suspended mixed oxides are applied over the tin oxide coating, with the liquid vehicle then volatilized to leave a residual film of the mixed oxides. There is then applied over the residual film of mixed oxides a coating paint which includes the phosphor means along with organic binder and the paint liquid vehicle. The paint liquid vehicle is volatilized and the envelope is then lehred at a sufficient temperature to burn out and remove the organic binder and to substantially volatilize the antimony oxide to cause it to contact the over-coated phosphor means which includes the zinc silicate phosphor. In this manner, the zinc silicate is effectively contacted by the volatilized antimony oxide in order to improve the performance of the phosphor and the resulting lamp.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
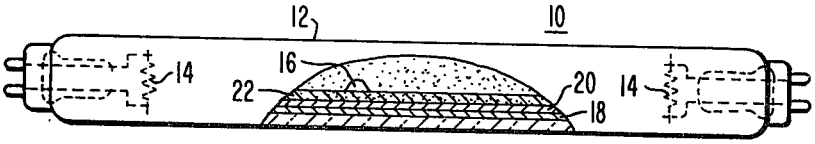
FIG. 1 is an elevational view, partly broken away, of a fluorescent lamp which has been prepared by processing in accordance with the present invention.

With specific reference to the form of the invention illustrated in the drawings, the lamp 10 as shown in FIG. 1 is generally conventional and comprises a sealed, elongated, light-transmitting envelope 12 having electrodes 14 operatively positioned therein proximate the ends thereof and enclosing a discharge-sustaining filling comprising mercury and a small charge of inert, ionizable starting gas such as two torrs of a mixture of 80–85 volume percent krypton and 20–15 volume percent neon, for example. When the lamp is energized, the resulting low-pressure mercury discharge generates ultraviolet radiations and a limited proportion of visible radiations, with the latter constituting a strong mercury line at 436 nm, a relatively strong green line at 546 nm, and a relatively weak line at 578 nm, with the composite mercury emission appearing blue to the eye.

The lamp 10 is specially adapted to be operated on a rapid-start ballast. To facilitate starting, there is coated on the inner surface of the envelope 12 a light-transmitting, electrically conducting tin oxide layer 18. The presence of this conducting layer 18 causes adhesion difficulties with respect to the overcoated phosphor. To promote adhesion of the phosphor, there is coated over the layer 18 a film of sub-micron-size aluminum oxide particles 20. Such aluminum particles are sold under the trademark Aluminum Oxide "C" by Degussa Corporation. Coated over the film 20 of aluminum particles as a layer 22 is the phosphor means.

The phosphor blends as disclosed in U.S. Pat. No. 3,858,082 provide both good color rendition of illuminated objects and a high light output, and such blends are very useful in those fluorescent lamps as are designed to operate with a reduced wattage. Such a blend incorporates a divalent europium activated material as a blue-emitting phosphor component, manganese-activated zinc silicate phosphor as a green-emitting component and yttrium oxide activated by a trivalent europium as a red-orange emitting phosphor component. The relative proportions of these components can be varied to provide the lamp with predetermined correlated color temperatures which vary over a wide range, although the most popular color temperature for these lamps is about 3,000° K. As a specific example, to provide the lamp with a correlated color temperature of approximately 3,000° K, the blue-emitting phosphor component is strontium chloroapatite activated by divalent europium with the weight proportions of the blue-emitting to green-emitting to red-orange-emitting phosphors being approximately 4:24:72. The amount of the phosphor which is utilized can vary, and a typical example is a phosphor coating weight of approximately 4.7 mg/cm.

Figure 2:
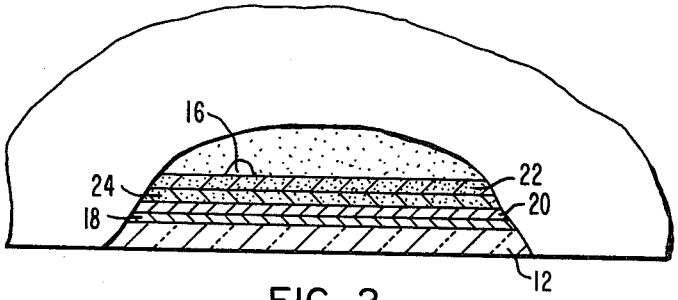
FIG. 2 is an enlarged fragmentary showing of a fluorescent lamp, partly broken away, generally similar to FIG. 1 but incorporating a double layer of phosphor.

The embodiment shown in FIG. 2 generally corresponds to that shown in FIG. 1 except that two discrete layers of phosphor are utilized wherein the innermost layer 22 is the three-component blend as previously described and an additional layer 24 is provided between the aluminum oxide film 20 and the phosphor layer 22. As a specific example, the additional layer 24 is formed of a mixture of apatite-structured calcium fluorophosphate and trivalent-activated yttrium oxide in the weight proportions of about 79:21 to produce a color temperature of approximately 3,000° K. Such a phosphor mixture is specifically described in detail in copending application Ser. No. 058,574, filed July 17, 1979 by Van Broekhoven et al., and owned by the present assignee, now U.S. Pat. No. 4,263,530, dated Apr. 21, 1981.

Figure 3:
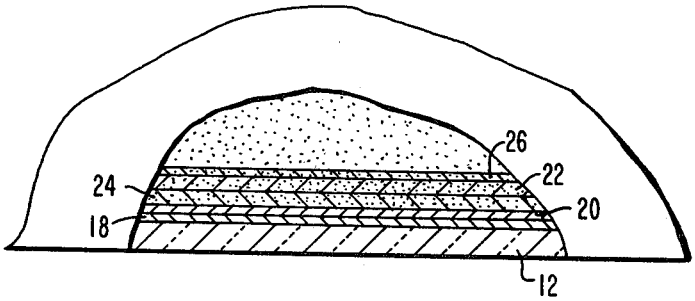
FIG. 3 is an enlarged fragmentary showing of a fluorescent lamp, partly broken away, generally similar to FIG. 1 but incorporating a triple layer of phosphor.

The embodiment shown in FIG. 3 generally corresponds to that shown in FIG. 2 except that an additional very thin layer of phosphor 26 is included over the three-component blend phosphor layer 22 in order to provide further protection for the phosphor layer 22. As a specific example, the layer 26 can comprise a very thin layer of blended phosphors activated by rare earth metals such as described in U.S. Pat. No. 3,937,998, dated Feb. 10, 1976.

While the thin film of aluminum oxide is an excellent adhesion promoter, when manganese-activated zinc silicate is utilized as a phosphor blend constituent, the aluminum oxide exhibits some tendencies to cause the zinc silicate phosphor to display a relatively rapid depreciation of light output, particularly at the end portions of the lamp, which can result in color shifts. As previously pointed out, it has long been known to add a small amount of antimony oxide to a silicate phosphor in order to improve the performance thereof. This is not as effective as desired, however, especially when the phosphor is to be coated over the film of aluminum oxide particles.

In accordance with the present invention, the aluminum oxide prior to application onto the tin-oxide-coated envelope interior surface is suspended in a liquid vehicle, and a predetermined amount of finely divided antimony oxide is included in mixed suspension therewith. The liquid vehicle is then volatilized to leave a residual film of the mixed oxides coated over the conductive coating. There is then applied over the residual film of mixed oxides, a coating paint which includes the phosphor to be used along with organic binder and a liquid paint vehicle. The liquid paint vehicle is volatilized and the envelope is then heated, i.e., lehred, at a sufficient temperature to burn the organic binder therefrom and to substantially volatilize the antimony oxide from the deposited film to cause the antimony oxide to contact the overcoated phosphor which includes the zinc silicate as a phosphor blend constituent.

As a specific example, aluminum oxide is dispersed as a colloidal suspension in deionized water, preferably with a small additive of defoamer and wetting agent, as is known in the art, with the specific gravity of the suspended aluminum oxide colloidal slurry being approximately 1.025. To the colloidal suspension of aluminum oxide is added finely divided antimony oxide in such an amount as to constitute about 10 percent by weight of the aluminum oxide. Preferably, the antimony oxide is in the form of the trioxide ($Sb_2O_3$) with an average particle size of approximately 1.2 microns. The resulting slurry is then sprayed onto the interior surface of the previously tin-oxide-coated fluorescent tube. For a tube having an interior surface area of approximately 1275 $cm^2$, approximately 130 mg of alumina and 13 mg of antimony oxide provide excellent results. The residual water is then dried, leaving a residual film of the mixed oxides.

In the next processing step, the phosphor is coated onto the previously deposited aluminum oxide. The phosphor can be deposited as one layer 22 as shown in FIG. 1, as two layers 22 and 24 as shown in FIG. 2, or as three separate layers 22, 24, 26 as shown in FIG. 3. In all of the embodiments as shown, the layer 22 includes the manganese-activated zinc silicate as a phosphor blend constituent. As a specific example, for a single layer 22 of phosphor as shown in FIG. 1, approximately six grams are coated onto the lamp envelope which has an interior surface area of 1275 $cm^2$. If a double layer of phosphor is utilized, such as in the embodiment shown in FIG. 2, the first-applied layer is lehred at a relatively low temperature such as 550° C. for one minute, which is insufficient to volatilize more than a minor amount of the antimony oxide from the mixed oxide layer. Thereafter, when the second layer 22 is applied, it is lehred at a temperature such as 650° C. for one minute, which is sufficient to volatilize substantially all of the residual antimony oxide from the mixed oxide film. The vaporized antimony oxide passes through the deposited phosphor and contacts the zinc silicate phosphor in a very effective manner. Thereafter, if a third layer 26 of phosphor is used, it is deposited over the layer 22 to complete the embodiment as shown in FIG. 3. The preferred binder material is polyethylene oxide and a coating system which uses such a binder material to deposit phosphor is described in detail in Canadian Pat. No. 1,045,908 dated Jan. 9, 1979.

Preferably, the antimony oxide is in the form of antimony trioxide ($Sb_2O_3$), and the antimony trioxide is deposited onto the tin oxide coating with the aluminum oxide in such an amount that the total deposited antimony trioxide constitutes from about 0.1 percent to about 0.5 percent by weight of the total phosphor which is to be thereafter deposited on the envelope interior surface. The aluminum oxide is preferably deposited onto the envelope interior surface in amount of from about 0.04 $mg/cm^2$ to about 0.13 $mg/cm^2$. Preferably the weight ratio of the antimony oxide to the aluminum oxide in the residual film, prior to the antimony oxide being volatilized, is from about 1:3 to about 1:15.

In a first control test, zinc-silicate-containing lamps were prepared which utilized a mixed antimony oxide and aluminum oxide precoat and their performance was compared to otherwise identical lamps which did not use any aluminum oxide precoat, but which used the antimony oxide in the phosphor coating paint. The initial light output for both types of lamps was equivalent, but the 100-hour maintenance of light emission for the lamps using the antimony oxide in the aluminum oxide precoat was about two percent better than the lamps which used the antimony oxide in the phosphor coating paint. In another control test, zinc-silicate-containing lamps were prepared which used only an aluminum oxide precoat, with the antimony oxide included in the coating paint. Their initial performance was compared to that of otherwise identical lamps which utilized both aluminum oxide and antimony oxide in the precoat and no antimony oxide in the coating paint. Again, the initial light output for both types of lamps was equivalent, but the 100-hour maintenance of light emission for the lamps using the antimony oxide in the aluminum oxide precoat was about two-percent better than the equivalent light emission for the lamps which used the antimony oxide in the coating paint. In all cases, lamps which used the antimony oxide in the aluminum oxide precoat displayed no tendencies for color shifts of the blend, which was attributable to the improved performance of the zinc silicate phosphor. Lamps which did not use the antimony oxide in the aluminum oxide precoat displayed a tendency for color shifts at the ends of the lamps.

The same degree of improvement as outlined hereinbefore can be obtained with green-appearing fluorescent lamps wherein the major or sole phosphor constituent is manganese-activated zinc silicate used in a lamp which has a tin oxide conducting coating on the envelope interior surface. By including the antimony oxide with the aluminum oxide, and processing as outlined hereinbefore, the antimony oxide is volatilized to contact the zinc silicate phosphor to improve the performance thereof.

We claim:

1. A fluorescent lamp comprising a sealed elongated light-transmitting envelope having electrodes operatively positioned therein proximate the ends thereof and enclosing a discharge-sustaining filling comprising mercury and a small charge of inert ionizable starting gas, a transparent electrically conducting coating substantially comprising tin oxide carried on the interior surface of said envelope, a thin substantially transparent coating principally comprising sub-micron-size aluminum oxide particles carried on said tin oxide coating, and finely divided phosphor means coated over said aluminum oxide, said phosphor means comprising manganese-activated zinc silicate phosphor, said lamp having been fabricated with the improved processing step which comprises:

said aluminum oxide prior to application onto said tin-oxide-coated envelope interior surface is suspended in a liquid vehicle and a predetermined amount of finely divided antimony oxide is included in mixed suspension therewith, said vehicle-suspended oxides are applied over said tin oxide coating and the liquid vehicle then volatilized to leave a residual film of said mixed oxides, said phosphor means are then coated over said film of mixed oxides together with organic binder which must thereafter be burned out by lehring, and during the lehring processing of said coated phosphor means, substantially all of said residual antimony oxide is volatilized to contact said manganese-activated zinc silicate phosphor.

2. The lamp as specified in claim 1, wherein said phosphor means comprises predetermined amounts of different phosphors formed in at least one discrete layer, and said phosphor means includes as a constituent thereof said manganese-activated zinc silicate phosphor.

3. The lamp as specified in claim 2, wherein said antimony oxide is in the form of antimony trioxide, and said antimony trioxide is deposited with said aluminum oxide on said tin oxide coating in such amount that the total deposited antimony trioxide constitutes from about 0.1 percent to about 0.5 percent by weight of the total phosphor means to be thereafter deposited on said residual film of mixed oxides.

4. The lamp as specified in claim 3, wherein said aluminum oxide is deposited onto said tin oxide coating in amount of from about 0.04 mg/cm$^2$ to about 0.13 mg/cm$^2$.

5. The lamp as specified in claim 3 or 4, wherein the weight ratio of said antimony oxide to said aluminum oxide in said residual film of mixed oxides is from about 1:3 to about 1:15.

6. The method of effectively exposing manganese-activated zinc silicate phosphor to antimony oxide in order to improve the performance of the zinc silicate phosphor when it is included in a fluorescent lamp which utilizes a tin-oxide conductive coating on the envelope interior surface, which method comprises:

in the lamp manufacturing process and after the tin oxide coating has been applied to said envelope, suspending predetermined proportions of submicron-size aluminum oxide and finely divided antimony oxide in a liquid vehicle, applying said vehicle-suspended mixed oxides over said tin oxide coating, and volatilizing said liquid vehicle to leave a residual film of said mixed oxides; and applying over said residual film of mixed oxides a coating paint which includes said zinc silicate phosphor and organic binder and paint liquid vehicle, volatilizing said paint liquid vehicle, and lehring said envelope at a sufficient temperature to burn said organic binder therefrom and substantially volatilize said antimony oxide to cause it to contact the overcoated zinc silicate phosphor.

7. The method as specified in claim 6, wherein said zinc silicate phosphor is a constituent of a blend of different phosphors.

8. The method as specified in claim 7, wherein said antimony oxide is in the form of antimony trioxide, and said antimony trioxide is deposited onto said tin oxide coating with said aluminum oxide in such amount that the total deposited antimony trioxide constitutes from about 0.1% to about 0.5% by weight of the total phosphor means to be thereafter deposited on said residual film of mixed oxides.

9. The method as specified in claim 8, wherein said aluminum oxide is deposited onto said tin oxide coating in amount of from about 0.04 mg/cm$^2$ to about 0.13 mg/cm$^2$.

10. The method as specified in claim 8 or 9, wherein the weight ratio of said antimony oxide to said aluminum oxide in said residual film of mixed oxides is from about 1:3 to about 1:15.

* * * * *